US006718652B2

(12) United States Patent
Klug et al.

(10) Patent No.: US 6,718,652 B2
(45) Date of Patent: Apr. 13, 2004

(54) ROTARY PARTICLE-DRYING DRUM

(75) Inventors: Andreas Klug, Krefeld (DE); Wolfgang Schröder, Krefeld (DE)

(73) Assignee: Buttner Gesellschaft fur Trocknungs-und Umwelttechnik mbH, Krefeld (DE)

( * ) Notice: Subject to any disclaimer, the term of this patent is extended or adjusted under 35 U.S.C. 154(b) by 33 days.

(21) Appl. No.: 10/093,075

(22) Filed: Mar. 7, 2002

(65) Prior Publication Data

US 2002/0124430 A1 Sep. 12, 2002

(30) Foreign Application Priority Data

Mar. 10, 2001 (DE) ..... 101 11 613

(51) Int. Cl.[7] ..... F26B 11/02

(52) U.S. Cl. ..... 34/135; 34/142; 34/147; 34/185

(58) Field of Search ..... 34/135, 136, 142, 34/147, 184, 185

(56) References Cited

U.S. PATENT DOCUMENTS 3,713,633 A * 1/1973 Falk et al. ..... 432/109
3,950,861 A * 4/1976 Weimer et al. ..... 34/130
4,338,732 A * 7/1982 Coxhill ..... 34/135
4,628,614 A * 12/1986 Thompson ..... 34/387
4,894,930 A * 1/1990 Shinn ..... 34/136
5,157,849 A * 10/1992 Ronning ..... 34/135
6,119,363 A 9/2000 Bahner

FOREIGN PATENT DOCUMENTS

DE 33 45 118 2/1985

* cited by examiner

*Primary Examiner*—Ira S. Lazarus
*Assistant Examiner*—Kathryn S. O'Malley
(74) *Attorney, Agent, or Firm*—Herbert Dubno; Andrew Wilford

(57) ABSTRACT

A rotary particle dryer has a shaft extending along an axis and a hollow drum coaxially and spacedly surrounding the shaft and rotatable about the axis in a direction. A set of axially extending inner baffles fixed to the shaft extend radially outward therefrom and each form at least one angularly open inner pocket. A set of axially extending outer baffles fixed to the drum extend radially inward therefrom and each form at least two angularly open outer pockets. Structure mechanically connects the inner baffles directly with the outer baffles.

13 Claims, 3 Drawing Sheets

ROTARY PARTICLE-DRYING DRUM

FIELD OF THE INVENTION

The present invention relates to a rotary particle-drying drum. More particularly this invention concerns such a drum used to dry wood chips for the production of oriented-strand board.

BACKGROUND OF THE INVENTION

Commonly owned U.S. Pat. No. 6,119,363 described a rotary drying drum comprising a generally cylindrical outer wall centered on and rotatable about a horizontal axis and provided with axially rowed sets of axially extending baffles that extend radially inward from outer edges attached to the outer drum wall. These baffles are of zig-zag shape so as to form pockets and have inner ends that stop somewhat short of a central shaft extending through and carrying the drum. Each baffle has several sections extending at an angle of about 90° to one another and forming at least two angularly open pockets and the sets of baffles are set so the material cascades from the pockets of one set of baffles to the next as the drum rotates. Around twenty such baffles in each set extend to close to the center shaft at the axis of the drum. Struts extending from an inner ring stabilize the baffles.

In order to dry wood chips between 5 mm and 50 mm wide and 75 mm to 175 mm long the drum has fewer, normally about twelve, baffles that have inner ends spaced somewhat farther out from the drum axis. No inner tube is used to dry these larger chips.

As the drum diameter is increased to increase the capacity of the dryer, it becomes necessary to similarly increase the number of baffles. As a result their spacing at their radial inner ends can become quite small so it has been suggested to shorten some of the baffles in order to prevent clogging. Such shortening reduces the contact area and, thus, the efficiency of the dryer. Drums of large diameter, 5 m to 6 m, cannot have a properly dimensioned inner tube.

German patent 3,345,118 of Otto Brudern describes a sugar-drying rotary drum having axially succeeding sets of outer axially extending baffles each having an outer edge secured to the drum, extending radially inward therefrom, and each forming an angularly open pocket. Axially succeeding sets of inner axially extending baffles each have an inner edge secured to a center shaft, extend radially outward therefrom, and each form an angularly open pocket directed angularly opposite to the outer pockets. Thus sugar fed in one end of the drum is poured from the outer pockets to the inner pockets across a considerable space between the inner edges of the outer baffles and the outer edges of the inner baffles.

Wood chips do not flow like sugar particles so such a rotary drum is not efficient at drying these types of particles. Dropping the particles through a substantial radial gap results in clumping and jamming. Furthermore the rigid interconnection of parts in this and similar systems causes considerable stresses when they are heated and expand. Thus the baffles can become loose as the fatigued joints where they are connected to the drum and shaft fail. Furthermore the known drums are not often sufficiently stiff with respect to torque so that, especially when heated, they can deform.

OBJECTS OF THE INVENTION

It is therefore an object of the present invention to provide an improved rotary particle-drying drum.

Another object is the provision of such an improved rotary particle-drying drum which overcomes the above-given disadvantages, that is which is particularly effective at drying wood chips and that at the same time is of durable construction that can be counted on to have a long service life.

SUMMARY OF THE INVENTION

A rotary particle dryer has according to the invention a shaft extending along an axis and a hollow drum coaxially and spacedly surrounding the shaft and rotatable about the axis in a direction. A set of axially extending inner baffles fixed to the shaft extend radially outward therefrom and each form at least one angularly open inner pocket. A set of axially extending outer baffles fixed to the drum extend radially inward therefrom and each form at least two angularly open outer pockets. In accordance with the invention structure mechanically connects the inner baffles directly with the outer baffles.

Thus the generally zig-zag shaped baffles are limitedly elastically deformable radially of the axis and can readily deform when heated without damage to the structure. The baffles are cascaded to make this even more effective, and also ensures that the material being dried flows from the outer baffles to the inner baffles for best possible drying. On the other hand the baffles have a certain torsional rigidity so that the drum will not go far enough out of shape to be damaged. Securing the outer baffles to the inner baffles rather than to other structure in the drum reduces the likelihood of blocking the flow of particles, here normally chips for oriented-strand board, through the machine.

The structure according to the invention includes an inner ring fixed to the inner baffles, an outer ring fixed to the outer baffles, and a plurality of struts extending radially between and fixed to the rings. Both of the rings are centered on the axis and the struts extend generally radially. Normally the struts and rings are made of sheet steel.

At least some of the outer baffles have rear faces directed backward in the direction and provided with stiffening reinforcement. This reinforcement is respective radially and angularly extending bars fixed to the rear faces.

Furthermore according to the invention the drum has a predetermined inner radius from the axis, and the inner baffles have a radial dimension equal to between 20% and 40% of the radius. Similarly the inner baffles have radial outer ends spaced from inner ends of the outer baffles by a radial distance equal to between 5% and 15% of the radius. Such dimensions are particularly effective with chips between 100 mm and 150 mm long and between 20 mm and 50 mm wide in a drum having a diameter of 5 m to 6 m.

According to the invention there is an even number of the outer baffles and there are half as many inner baffles as outer baffles. The outer baffles include long outer baffles and short outer baffles alternating with the long outer baffles. The inner baffles are radially generally aligned with the short outer baffles.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
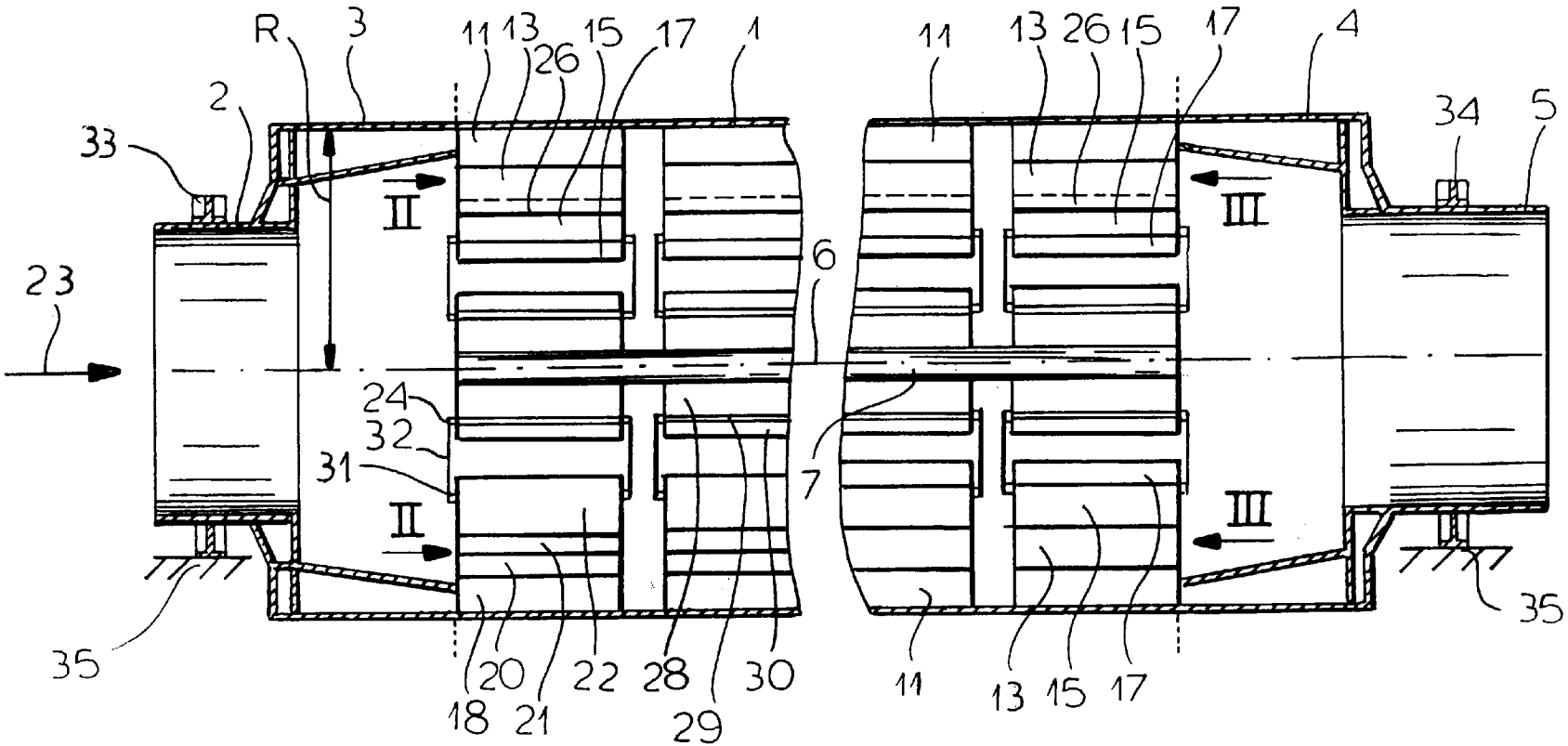
FIG. 1 is a partly diagrammatic axial section taken along lines I—I of FIGS. 2 and 3.
Figure 2:
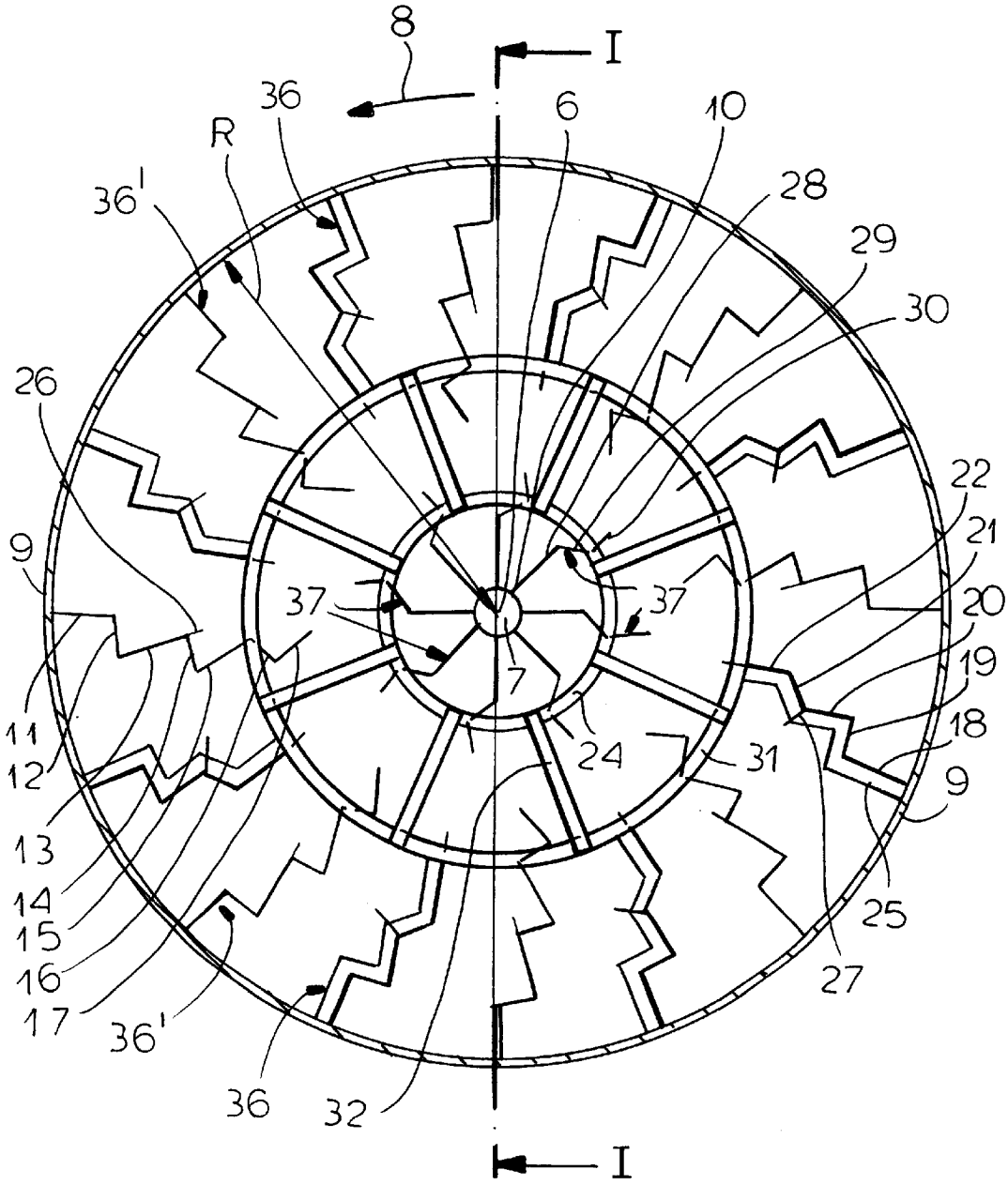
FIGS. 2 and 3 are sections taken along respective lines II—II and III—III of FIG. 1.
Figure 3:
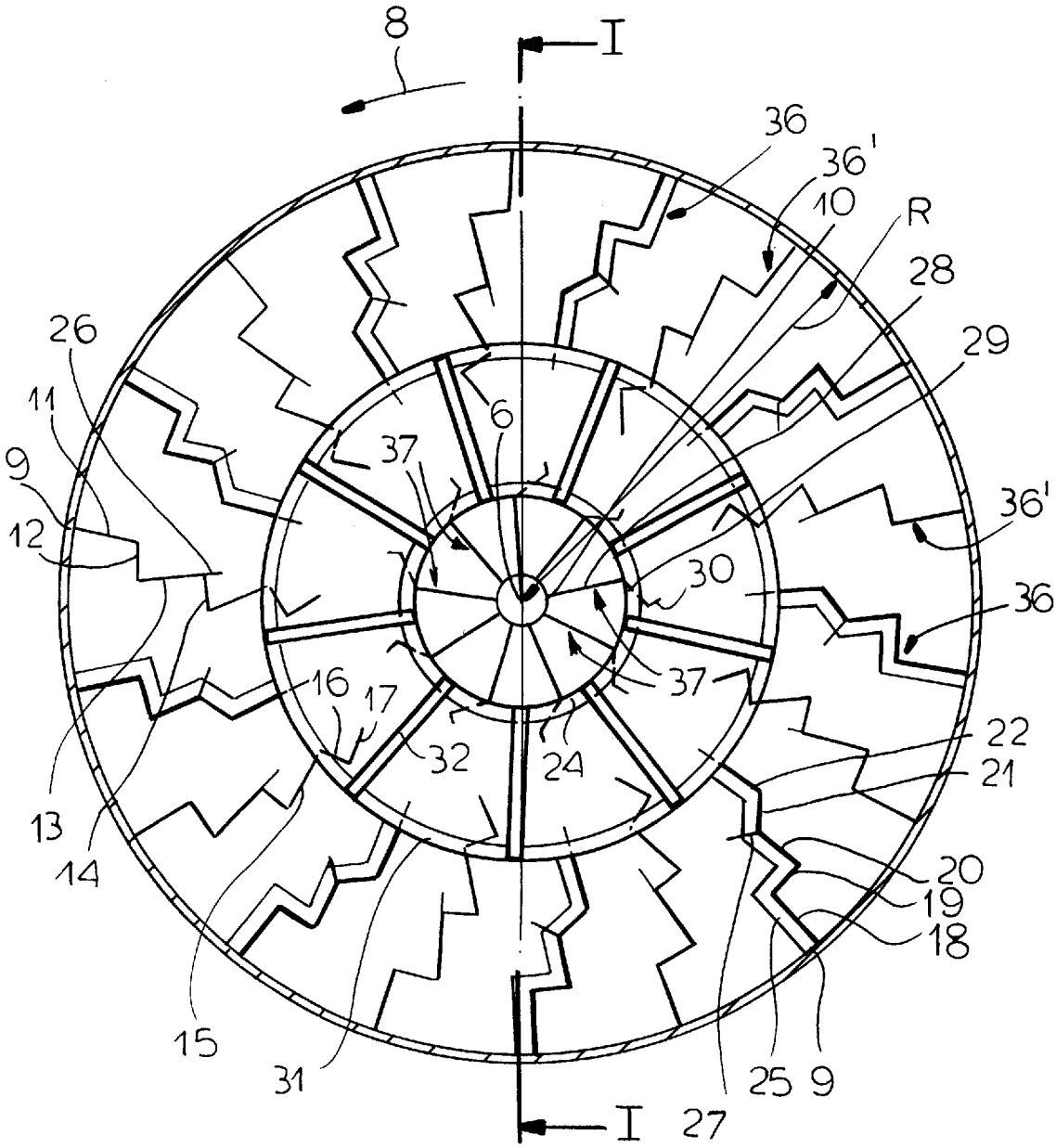

As seen in FIG. 1 a drying drum has a pair of tubularly cylindrical parts 2 and 3 forming an inlet, a pair of similar parts 4 and 5 forming an outlet, a cylindrically tubular center part 1 between them of substantially larger radius R, and a center shaft 7, all centered on a common axis 6. The small-diameter end parts 2 and 5 have rings 33 and 34 by means of which they are supported in bearings on a base illustrated schematically at 35 for rotation of the assembly about the axis 6 in a direction 8 (FIGS. 2 and 3).

The center drum part 1 holds nine axially spaced sets of outer sheet-metal baffles 36 and 36' and inner baffles 37 with the baffles 36 alternating with the baffles 36'. Relative to a direction 23 in which particles to be dried move through the drum, there are sixteen outer baffles 36 and 36' and eight inner baffles 37 in each of the upstream three sets and eighteen outer baffles 37 and nine inner baffles 37 in each of the downstream six sets. Each set of baffles 36, 36' or 37 is spaced axially from any adjacent upstream or downstream sets. All the baffles 36 and 36' are generally identical as are all the baffles 37. Each set of baffles 36 and 36' and 37 further has inner stabilizing rings 24, coaxial outer stabilizing rings 31, and struts 32 extending radially between them. The outer baffles 36 and 36' have outer edges 9 welded to an inner face of the drum part 1 and the inner baffles 37 have inner edges 10 welded to the shaft 7.

More particularly, each of the outer baffles 36 and 36' has an overall radial dimension equal to between 40% and 60%, preferably 45% to 59% of the radius R. The baffles 36 and 36' include long outer baffles 36' which each form three pockets and which each have a radial dimension equal to 0.57R. Each long outer baffle 36' has seven sections 11, 12, 13, 14, 15, 16, and 17, the outer section 11 having the edge 9 secured to the drum part 1. The first pocket formed by the sections 11 and 12 has an apex angle of 95° and the section 12 inclined 0° to a perpendicular from a radius from the axis 6. The second pocket formed by the sections 13 and 14 has an apex angle of 88° and an inclination of the section 14 of −12°, and the third pocket formed by the sections 15 and 16 has an apex angle of 83° and an inclination of −23°. The sections 11, 13, and 15 each have a radial dimension of 0.15R and the sections 12, 14, and 16 respectively of 0.09R, 0.08R, and 0.08R. The last section 17 is inclined at −25° and has a radial dimension of 0.09R. Axially extending ribs 26 form inward extensions of the sections 13.

The shorter baffles 36 each form two pockets and each have an overall radial dimension equal to 0.49R. Each baffle 36 has five sections 18, 19, 20, 21, and 22, the outer section 18 having the edge 10 secured to the shaft 7. The first pocket formed by the sections 18 and 19 has an apex angle of 95° and an inclination of 0°, and the second pocket formed by the sections 20 and 21 has an apex angle of 118° and an inclination of −12°. The sections 18, 19, 20, 21, and 22 have respective radial dimensions of 0.15R, 0.10R, 0.12R, 0.08R, and 0.17R. The section is inclined at −2°. The shorter baffles 36 have on their rear faces reinforcing strips or ribs 25 formed as metal bars welded in place. Axially extending ribs 27 project inward from the apexes of the sections 20 and 21 generally perpendicular to the sections 21.

The outer rings 31 are made of sheet metal and are provided at each axial end of each set of outer baffles 36 and 36'. They are fixed to the baffles 36 and 36' and are spaced outward from the axis 6 by between 0.40R and 0.50R. Thus the rings engage the long baffles 36' at the apexes of the innermost pockets formed by the sections 15 and 16 and the short baffles 36 just outward of the inner ends of their innermost sections 22.

As mentioned above, there are in each set one-half as many inner baffles 37 as outer baffles 36 and 36', that is eight in the upstream three sets and nine in the downstream six sets. Each inner baffle 37 is generally radially aligned with a respective one of the short outer baffles 36 and each inner baffle extends outward from the axis 6 by a radial dimension of about 0.02R to 0.40R, here 0.31R. Thus a gap equal to between 0.05R and 0.15R is left open between the outer ends of the inner baffles 37 and the inner ends of the long outer baffles 36'.

The inner rings 24 are also made of sheet metal and are provided at each end of each set of baffles 37. They are fixed to the baffles 37 and are spaced outward from the axis 6 by between 0.20R and 0.40R. In the upstream three baffle sets there are eight angularly equispaced and radially extending struts 32 extending between the rings 24 and 31 and in the downstream six baffle sets there are nine such struts 32 between each ring 24 and the respective ring 31.

The inner rings 31 are also made of sheet metal and are provided at each end of each set of baffles 37. They are fixed to the baffles 37 and are space outward from the axis 6 by between 0.20R and 0.40R. In the upstream three baffle sets there are eight angularly equispaced and radially extending struts 32 extending between the rings 24 and 31 and in the downstream six baffle sets there are nine such struts 32 between each ring 24 and the respective ring 31.

Thus as the drum rotates in the direction 8 the material captured in the forwardly open outer pockets of the outer baffles 36 and 36' will spill from them as the respective baffles 36 and 36' move up to the vertical 12-o'clock position. Due to the angles of the outer pockets, the material will spill first from the innermost pocket, then from the pocket inward thereof and so on. The material spilling from the outer pockets of the baffles 36 and 36' will mainly be caught by the backwardly open pockets of the inner baffles 37 which will spill out their contents as they move down into the vertical 6-o'clock position, and so on. This transfer between the outer baffles 36 and 36' and the inner baffles 37 ensures good contacting of the material being dried and the hot air circulated axially through the drum.

We claim:

1. A rotary particle dryer comprising:

a shaft extending along an axis;

a hollow drum coaxially and spacedly surrounding the shaft, rotatable about the axis in a direction, and having one end forming around the shaft an axially open inlet and an opposite end forming around the shaft an axially open outlet;

a set of axially extending inner baffles fixed to the shaft, extending radially outward therefrom, having radially outer ends, and forming radially outwardly and axially open inner pockets radially inwardly closed by the shaft;

a set of axially extending outer baffles fixed to the drum, extending radially inward therefrom, having radially inner ends, and forming radially inwardly and axially open outer pockets radially outwardly closed by the drum, the inner-baffle outer ends being spaced radially inward of the outer baffle inner ends; and structure connecting the inner baffles directly with the outer baffles such that particles can flow freely radially between the inner and outer pockets.

2. The rotary particle dryer defined in claim 1 wherein the baffles are cascaded.

3. The rotary particle dryer defined in claim 1 wherein the structure includes:

an inner ring fixed to the inner baffles;

an outer ring fixed to the outer baffles; and a plurality of struts extending radially between and fixed to the rings.

4. The rotary particle dryer defined in claim 3 wherein both of the rings are centered on the axis and the struts extend generally radially.

5. The rotary particle dryer defined in claim 3 wherein the struts and rings are made of sheet metal.

6. The rotary particle dryer defined in claim 1 wherein at least some of the outer baffles have rear faces directed backward in the direction and provided with stiffening reinforcement.

7. The rotary particle dryer defined in claim 6 wherein the reinforcement is respective radially and angularly extending bars fixed to the rear faces.

8. The rotary particle dryer defined in claim 1 wherein the drum has a predetermined inner radius from the axis, the inner baffles having a radial dimension equal to between 20% and 40% of the radius.

9. The rotary particle dryer defined in claim 1 wherein the drum has a predetermined inner radius from the axis, the inner-baffle outer ends being spaced from the outer-baffle inner ends by a radial distance equal to between 5% and 15% of the radius.

10. The rotary particle dryer defined in claim 1 where there is an even number of the outer baffles and there are half as many inner baffles as outer baffles.

11. The rotary particle dryer defined in claim 10 wherein the outer baffles include long outer baffles and short outer baffles alternating with the long outer baffles, the inner baffles being radially generally aligned with the short outer baffles.

12. The rotary particle dryer defined in claim 1 wherein the pockets of the outer baffles are open forwardly in the direction and the pockets of the inner baffles are open rearwardly in the direction.

13. The rotary particle dryer defined in claim 1 wherein the baffles are generally zig-zag shaped and limitedly elastically deformable radially of the axis.

* * * * *